US009783951B2

(12) United States Patent
Nilsson et al.

(10) Patent No.: US 9,783,951 B2
(45) Date of Patent: Oct. 10, 2017

(54) FRONT PIN LOCK FOR A TOOL ATTACHMENT DEVICE

(75) Inventors: Markus Nilsson, Sollentuna (SE); Sven Siggstedt, Norrtalje (SE); Stefan Stockhaus, Danderyd (SE)

(73) Assignee: STEELWRIST AB, Sollentuna (SE)

( * ) Notice: Subject to any disclaimer, the term of this patent is extended or adjusted under 35 U.S.C. 154(b) by 730 days.

(21) Appl. No.: 14/345,245

(22) PCT Filed: Sep. 11, 2012

(86) PCT No.: PCT/SE2012/050953

§ 371 (c)(1),
(2), (4) Date: Mar. 15, 2014

(87) PCT Pub. No.: WO2013/048308

PCT Pub. Date: Apr. 4, 2013

(65) Prior Publication Data

US 2014/0341648 A1 Nov. 20, 2014

(30) Foreign Application Priority Data

Sep. 15, 2011 (SE) ..... 1150837

(51) Int. Cl.

| | |
|---|---|
| ***B25G 3/18*** | (2006.01) |
| ***E02F 3/36*** | (2006.01) |
| ***E02F 9/26*** | (2006.01) |

(52) U.S. Cl.

CPC ..... *E02F 3/3609* (2013.01); *E02F 3/365* (2013.01); *E02F 3/3618* (2013.01); (Continued)

(58) Field of Classification Search

CPC ..... E02F 3/3609; E02F 3/3618; E02F 3/3622; E02F 9/26; E02F 3/3627; E02F 3/3645; E02F 3/365; E02F 3/3663

See application file for complete search history.

(56) References Cited

U.S. PATENT DOCUMENTS 6,379,075 B1 * 4/2002 Shamblin ..... E02F 3/3613 37/468
6,902,346 B2 * 6/2005 Steig, Jr. ..... E02F 3/3618 37/468

(Continued)

*Primary Examiner* — Michael P Ferguson
*Assistant Examiner* — Matthew R McMahon
(74) *Attorney, Agent, or Firm* — Gabriela B. Tomescu; Bergenstråhle & Partners AB

(57) ABSTRACT

A quick coupler (1) for attaching a tool (2), comprising an attachment bracket with two parallel attachment pins (3*a*, 3*b*), to an earth moving vehicle, where the quick coupler (1) comprises a frame (4) with a first cutout (5) and a second cutout (6) arranged substantially perpendicular to each other, which are adapted to cooperate with the respective attachment pin (3*a*, 3*b*) of the tool (2). The quick coupler (1) further comprises at least one, in relation to the frame (4) moveable locking arrangement (9), adapted to delimit the second cutout (6) in a direction parallel to the first cutout (5), whereby one of the attachment pins (3*aq*, 3*b*) of the tool is locked in the second cut-out (6) and at least one locking segment (18*a*, 18*b*) arranged to be rotated in relation to the frame (4) in at least a first and a second direction between different positions, whereby the locking segment (18*a*, 18*b*) in at least one position delimit the first cut-out (5) and locks the second of the attachment pins (3*a*, 3*b*) of the tool.

7 Claims, 6 Drawing Sheets

(52) U.S. Cl.
CPC ..... *E02F 3/3627* (2013.01); *E02F 3/3645* (2013.01); *E02F 3/3663* (2013.01); *E02F 9/26* (2013.01); *Y10T 403/7075* (2015.01)

(56) References Cited

U.S. PATENT DOCUMENTS

| | | | | |
|---|---|---|---|---|
| 7,648,305 | B2 * | 1/2010 | Beales | E02F 3/3618 172/272 |
| 7,828,070 | B2 * | 11/2010 | Calvert | E02F 3/3622 172/272 |
| 7,984,575 | B2 * | 7/2011 | Robl | E02F 3/3622 172/273 |
| 7,984,576 | B2 * | 7/2011 | Miller | E02F 3/3618 37/468 |
| 8,112,914 | B2 * | 2/2012 | Miller | E02F 3/3618 172/272 |
| 8,328,459 | B2 * | 12/2012 | Hill | E02F 3/3622 172/272 |
| 8,585,345 | B2 * | 11/2013 | Sikorski | E02F 3/3618 414/723 |
| 2010/0124453 | A1 | 5/2010 | Sikorsky | |
| 2010/0232920 | A1 * | 9/2010 | Calvert | E02F 3/3627 414/723 |

* cited by examiner

FRONT PIN LOCK FOR A TOOL ATTACHMENT DEVICE

TECHNICAL FIELD

The present invention relates generally to a quick coupler used for attaching a tool to an earth moving vehicle, where the quick coupler comprises a locking device and a front pin locking arrangement.

BACKGROUND ART

Today it is very common that quick couplers are used for connecting different tools to an earth moving machine, for example an excavator, backhoe loader or a digger. With the quick coupler the driver can quickly and simply switch between different tools, for example different buckets, which can be used for s certain work condition. The quick coupling is mounted directly on the excavator art or on a on the arm mounted tilt rotator which allow tool movement in all directions. It can also be integrated in the tilt rotator. The quick coupling has in its lower part a locking mechanism adapted to lock the tool, either mechanically or with a hydraulically controlled lock. The locking mechanism often comprises a solid grip and a locking wedge or locking pins which locks the tool around parallel axles attached to the attachment bracket.

Quick couplers can be divided into two groups; universal or dedicated. Universal quick couplers are characterized in that the quick coupler is constructed to be able to be used on tools originating from different tool manufactures. Since the tools originate from different tool manufacturers or different excavator models, the distance between the parallel axles can vary and the diameter of the axles can be different. Thus, a universal quick coupler normally fits tools with different distances between the axles and sometimes also fit tools with different axle diameter. Dedicated quick couplers are, on the other hand, based on a standard, which result in that the quick coupler only fits if the tool follows the standard from which the quick coupler is constructed. Only the upper part, i.e. the part mounted adjacent the excavator arm, varies while the locking mechanism follows a standard. The most common standard for quick couplers on the Nordic market is symmetrical quick couplers, which are based on a gate with two parallel axles.

A problem with quick couplers of today is that it is a large risk that the driver drops the tool during the connection of the tool to the excavator, since the driver believe that the tool is securely locked with the locking mechanism even though this is not the case. The tool is lifted and run the risk of falling out from the front grip of the tool coupler due to gliding of the tool front axle.

A number of attempts have been made to solve the above mentioned problem. In patent application US2008/0193210A1 it is disclosed a coupling arrangement between a boom and a tool comprising a safety mechanism to prevent unintentional release of the tool. The document discloses a rotatable safety locking part which is spring suspended and biased towards a locking position. The locking part is with lock lever arms connected to a hydraulic cylinder part. The disadvantage with this solution is that it is not possible to securely lock the arrangement in all positions of the locking arrangement. For example when the hydraulic cylinder is in a locking position for safety locking, the safety locking part cannot rotate to receive an attachment pin. The positioning of an attachment pin first requires an activation of the hydraulic cylinder.

WO2008/051095 A2 discloses a safety lock for one of the attachment pins comprising an hydraulic cylinder. Unlocking and locking of the safety lock occur actively through the cylinder. Just as in the previous mentioned document this solution does not permit locking of the safety lock for a locked position of the locking arrangement.

EP1318242 B1 discloses a system for making safety locking possible. The disadvantage with the system is that safety locking is not possible when the locking arrangement is in a locked position. The positioning of the attachment pin in a cut out is not possible when the locking arrangement is locked, only when it is open.

WO2010/062193A1 discloses a coupling arrangement for attachment of a working tool and a method for unlocking which requires several steps. The snap locking of a first attachment pin is possible by a floatingly suspended hydraulic cylinder, i.e. arranged to be able to move up and down in the coupling arrangement. The disengagement of the safety lock occurs actively by contraction of the hydraulic cylinder which thus is connected for this purpose. The disadvantage with this solution is that the floating suspension of a hydraulic cylinder, i.e. by letting a large number of included components be moveable, increases the risk of fatigue of the parts over time and thereto also the risk of failure in the locking arrangement which is a safety risk. In a manufacturing perspective it is also a disadvantage to be forced to predefine an exact movement space for the hydraulic cylinder to make unlocking possible.

WO2005/026454 A1 discloses a safety lock for quick coupling of a tool. Safety locking is however not possible when the locking arrangement is in a locked position, and it requires a 180° rotation for unlocking.

Another problem with quick couplers of today is that the lock indication often is indistinct and not always secure. Today normally an indicator rod/indicator pin is used which is connected to the locking arrangement of the quick coupler. This means that when the locking arrangement is retracted into the holder the lock is opened and the indicator rod becomes visible, which indicates that the lock is open. Such solutions are for example disclosed in WO02097201A1, U.S. Pat. No. 6,379,075B1 and U.S. Pat. No. 6,132,130A. Thus, the normal is that the quick coupler has a negative lock indication, i.e. it indicates when the lock is open. The risk with this solution is, if the indicator rod in either way is broken or removed the driver may believe that the lock is closed, since no indicator rod is visible, while it actually is open. In such case the risk is large that the tool is dropped, which can be dangerous for personnel working in the vicinity of the excavator.

Other locking arrangements are also know which makes it possible to indicate when the lock is locked. Such quick coupler lock indication arrangements are for example shown in US20100189535A1, EP0527733B1 and U.S. Pat. No. 5,692,855A.

In both US20100189535A1 and EP0527733B1 a locking arrangement is disclosed having the shape of a, in relation to the quick coupler, laterally extending hydraulically actuated pin, which both see to that the lock remains locked and which, with a colored outer part visible for the driver, indicates that this is the case. U.S. Pat. No. 5,692,855A shows a coupling arrangement where a handle visible for the observer is turned together with the locking arrangement and indicates locked and unlocked position, respectively.

These solutions either demand an extra hydraulic actuator and/or several mechanically connected components which can be loose or break. Thus, there is a need for a simple and reliable lock indicator for a quick coupler which clearly indicated for that driver that the tool is securely locked to the excavator.

SUMMARY OF INVENTION

An object of the present invention is to in a robust and safe way lock a quick coupler of an earth moving vehicle, for example an excavator, in a first and preferably a front attachment pin in a tool.

A further object is to in a simple and clear way indicate when the quick coupler is locked.

At least some of the above mentioned objects are achieved by the following:

According to one invention a quick coupler for attaching a tool comprising an attachment bracket with two parallel attachment pins to an earth moving vehicle is presented, where the quick coupler comprises a frame with a first cut-out and a second cut-out arranged substantially perpendicular to each other, where the respective cut-out is adapted to cooperate with the respective attachment pin of the tool, at least one, in relation to the frame moveable locking arrangement, adapted to delimit the second cut-out in a direction parallel to the first cut-out, whereby one of the attachment pins of the tool is locked in the second cut-out at least one, in the frame arranged, actuator adapted to move the locking arrangement between a first open and a second locked position, at least one locking piston arranged to be moved between an inner and an outer position, at least one locking segment arranged to be rotated in relation to the frame in a first and a second direction between different positions, whereby the locking segment in at least one position delimit the first cut-out, where the at least one actuator is arranged between the locking arrangement and the at least one locking piston and is arranged to move both the locking arrangement and the at least one locking piston in relation to the frame, that the at least one locking segment is arranged in relation to the locking piston so that the at least one locking segment is prevented to rotate in a first direction when the locking arrangement is in a locked position and is a allowed to rotate in the first direction when the locking arrangement is in an open position, that the at least one locking segment is arranged in relation the locking piston so that the locking segment is allowed to rotate in a second rotation direction when the locking arrangement is in either a locked or an open position, where the at least one locking segment is arranged to rotate in relation to the at least one locking piston.

According to a further embodiment a quick coupler is presented, in which the at least one locking piston has an outer end and an inner end whereby the at least one locking segment is arranged in relation to the at least one locking piston so that at least some point in the outer end of the locking piston is located at a first distance from the centre of rotation of the at least one locking segment by an outer position when the at least one locking arrangement is in a locked position, and where at least some point on the outer end of the at least one locking piston is located on a second distance from the centre of rotation of the at least one locking segment by an inner position, when the at least one locking arrangement is in an unlocked position, where the first distance is less than the second distance, where the at least one locking segment has a cam surface, by which the radius from the centre of rotation to the cam surface varies along the circumference of the locking segment, whereby the locking segment has a cam surface section at a corresponding first radius r1 and a second radius r2, whereby the first radius r1 is larger than the second radius r2.

According to another embodiment a quick coupler is presented, in which the first radius r1 of the at least one locking segment is larger than the first distance when the locking arrangement (9) is in a locked position an smaller than the second distance when the at least one locking arrangement (9) is in an open position and when the second radius r2 is smaller than the first distance when the at least one locking arrangement (9) is in a locked position and smaller that the second distance when the at least one locking arrangement (9) is in an open position.

According to another embodiment a quick coupler is presented, in which a locking plate is arranged to the hydraulic cylinder, whereby the inner end of the at least one locking piston is mechanically disconnected from the locking plate, whereby the inner end of the at least one locking piston is at a third distance from the locking plate, whereby the third distance is null when the at least one locking arrangement is in a locked position.

According to one embodiment a quick coupler is presented, in which the first radius r1 of the at least one locking segment is larger than the sum of the second distance and the third distance when the at least one locking arrangement is in a locked position and smaller than the sum of the first and the third distance when the at least one locking arrangement is in an open position and where the second radius r2 is smaller than the sum of the first and the third distance when the at least one locking arrangement is in a locked position and smaller than the sum of the second and the third distance when the at least one locking arrangement is in an open position.

According to one embodiment a quick coupler is presented, in which a first attachment pin with a first diameter D is adapted to be inserted through an opening to rest in a horizontal first cut-out, whereby the second radius r2 is defined by having a corresponding cam surface section located on a shortest distance a to the opposite wall of the opening when the at least one locking arrangement is located in a locked position and the first attachment pin is inserted to rest in the horizontal first cut-out and the at least one locking segment is limiting the first cut-out, whereby the first radius r1 is defined as having a cam surface section which at this position touches a part of the outer ends of the at least one locking piston, whereby the first radius r1 is of such a length that the first diameter D is larger than the shortest distance a to the opposite wall of the opening when the at least one locking arrangement is located in a locked position and the first attachment pin is inserted to rest in the horizontal cut-out and the at least one locking segment delimits the first cut-out.

According to one embodiment a quick coupler is presented, in which the at least one locking piston is adapted to be moved essentially linearly by the at least one actuator in at least one direction essentially parallel to the extension direction of the first cut-out.

According to one embodiment a quick coupler is presented, in which the at least one locking arrangement and the at least one locking piston are arranged to be moved essentially simultaneously in opposite directions.

According to one embodiment a quick coupler is presented, in which a spring is arranged in connection to the at least one locking segment with the purpose of biasing the at least one locking segment in a first direction of rotation.

According to one embodiment a quick coupler is presented, which comprises a lock indication device which visually indicates if the locking arrangement is in an open or closed position, in which the at least one actuator is arranged between the at least one locking arrangement and the at least one lock indication device and is arranged to move both the at least one locking arrangement and the lock indication device in relation to the frame so that the lock indication device visually indicates when the at least one locking arrangement is in the locked position, whereby the lock indication device and the at least one locking piston are arranged in the locking plate on the same side of the at least one actuator.

BRIEF DESCRIPTION OF DRAWINGS

The invention is now described, by way of example, with reference to the accompanying drawings, in which.

DESCRIPTION OF EMBODIMENTS

Figure 1:
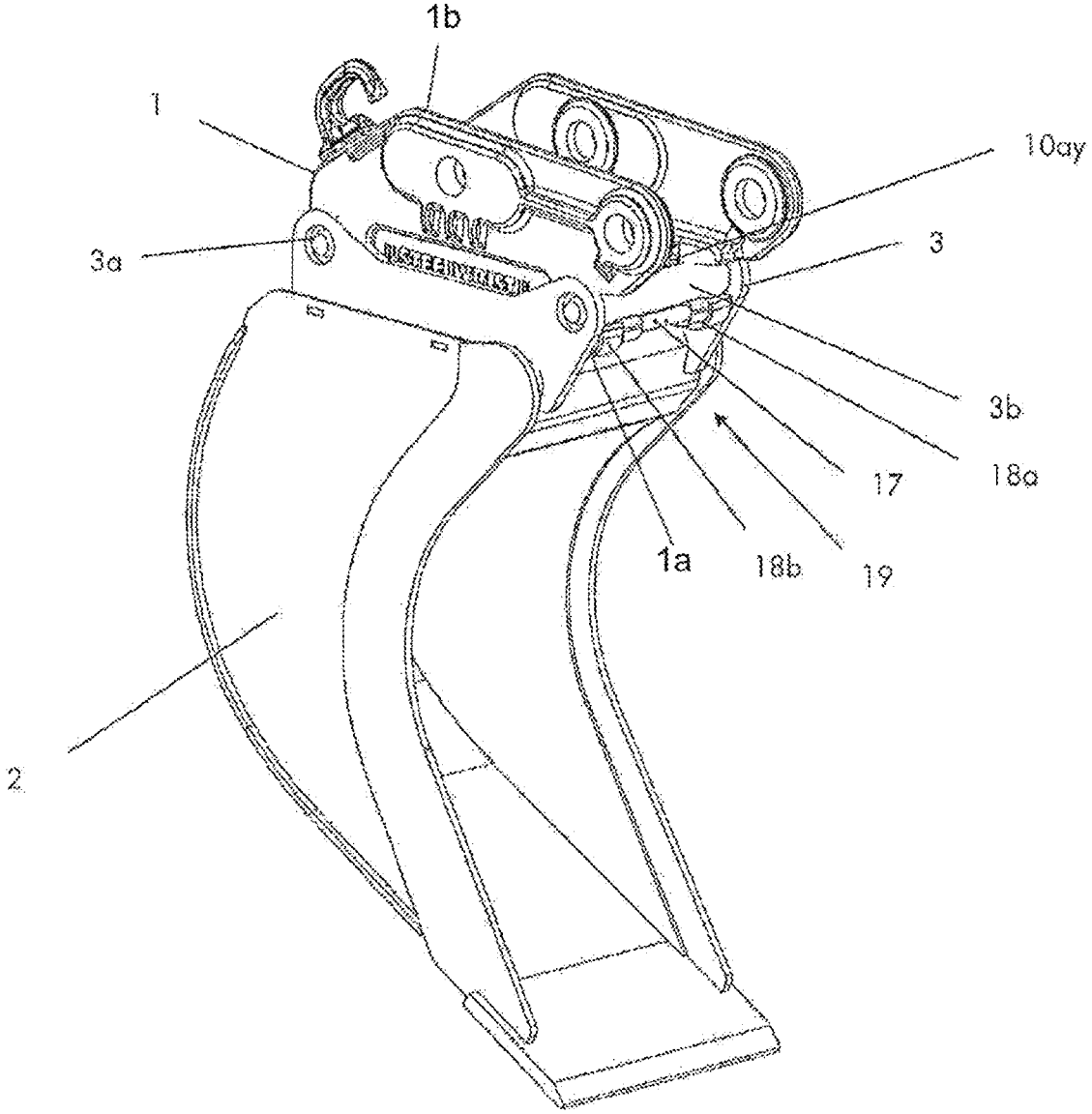
FIG. 1 shows a quick coupler attached to a tool.

In the following, it is provided a detailed description of embodiments:

FIG. 1 shows a quick coupler 1 attached in its lower part 1*a* in a tool 2, in this case a bucket. The quick coupler 1 is attached to the tool by means of an attachment bracket 3, which is a frame comprising two parallel attachment pins 3*a*, 3*b* which extend in a direction essentially parallel to both tool 2 and quick coupler 1. The upper part 1*b* of the quick coupler can be directly attached to an arm of an earth moving machine, for example an excavator, digger or any other machine adapted to perform earth moving operations. The quick coupler 1 can also be mounted by or integrated in a, on the arm mounted, tilt rotator which permits tool movement in all directions (not disclosed).

Figure 2:
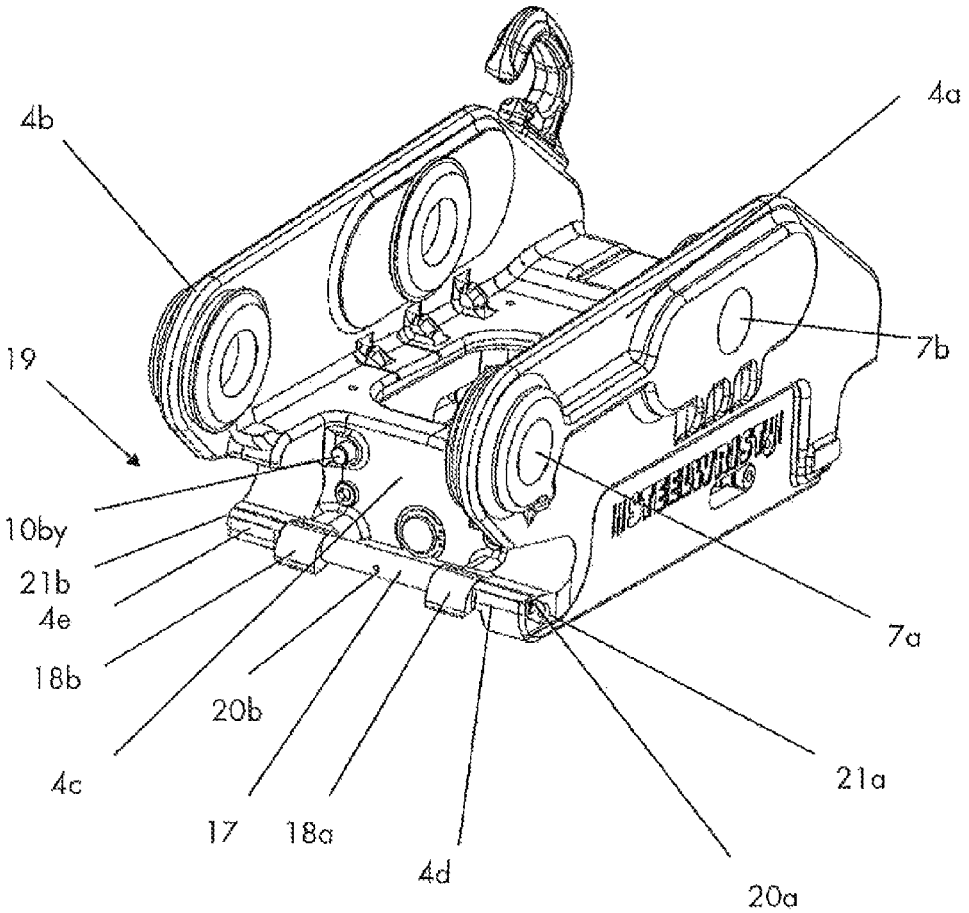
FIG. 2 shows a perspective view of a quick coupler and in particular the front pin locking arrangement.

FIG. 2 discloses a perspective view of the quick coupler with a front pin locking arrangement 19. The visible parts of the front pin locking arrangement is in the figure composed by the middle axle 17 which is fixed in a frame 4 preferably by a support axle 20*a* which runs through the respective lateral portions 4*a* and 4*b* of the frame, by the lateral portion sectors 4*d* and 4*e*, through the hollow middle axle 17. A locking plate 21*a* and 21*b* in one end of the support axle 10*a* clamps this in its direction of rotation using two non circular holes in which the non circular ends of the support axle 20*a* are adapted to fit. Around the middle axle 17 two locking segments 18*a* and 18*b* are arranged in order to rotate around the same. The locking segments 18*a* and 18*b* have preferably a non circular cam surface and each segment comprises a spring arrange to be biased to rotate in a first direction. The biasing of the locking segment 18*a*, 18*b* can be done for example by rotating the middle axle 17 in relation to these and the support axle 20*a* and then with a locking pin 20*b* which is inserted through the surface of the middle axle in the support axle 10*a*, lock the middle axle 17 in relation to the support axle 10*a* so that a relative rotation between the parts are no longer possible. The springs are encircled by o-rings arranged at the respective end of the locking segment in order to seal against dirt and moisture. (not disclosed) The locking segments 18*a*, 18*b* are preferably arranged in vicinity of the lateral part sectors 4*d* and 4*e*, by each end of the middle axle 17.

Figure 3A:
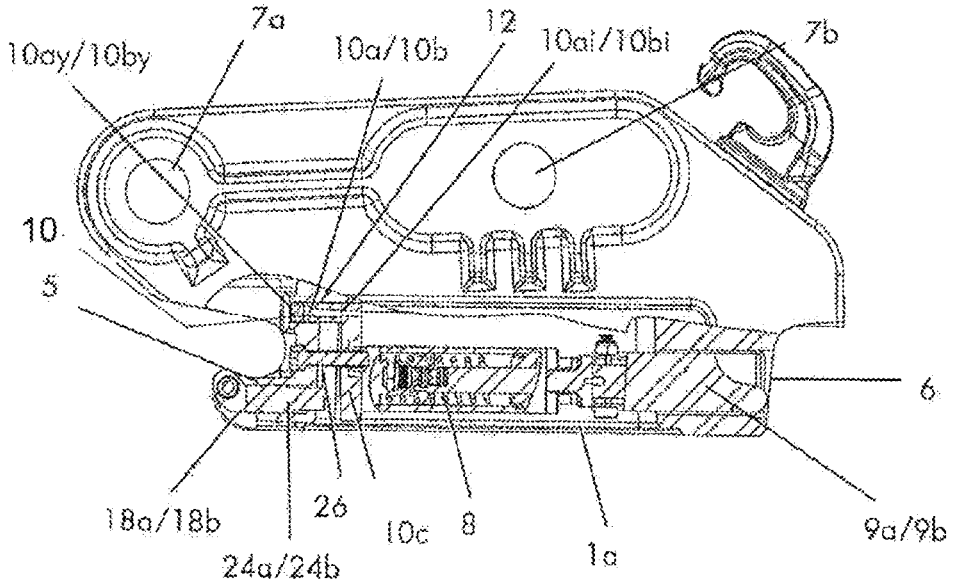
FIG. 3*a* shows a side view of a quick coupler in an unlocked position.
Figure 3B:
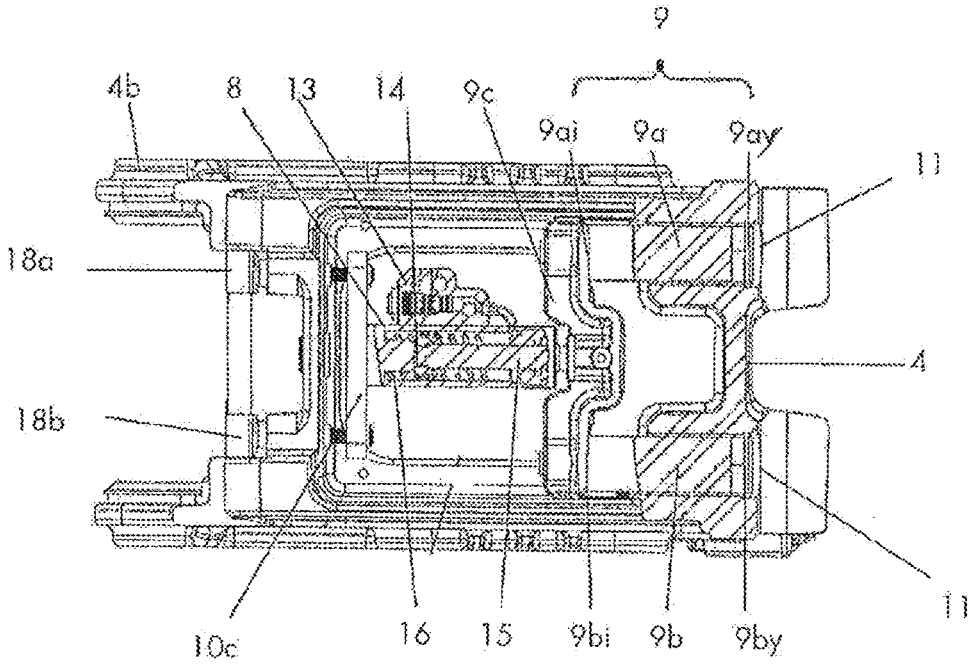
FIG. 3*b* shows a plan view of a quick coupler in an unlocked position.

FIGS. 3*a* and 3*b* shows detail views of the quick coupler when it is in an open position, i.e. when no tool is attached. FIG. 2*a* shows a side view of the coupler and FIG. 2*b* a plan view of the coupler. The side view can be said to be a vertical view and the plan view a horizontal view, when the coupler is so arranged in space that the lower edge 1*a* of the coupler is arranged essentially horizontal to the ground. Since the quick coupler, especially if attached to a tilt rotator, can rotate around several axles, this position is only one out of several possible positions. Thus, when the expressions horizontal and vertical are used, reference is only made to FIG. 3*a*.

The quick coupler 1 in FIGS. 3*a*, 3*b* and FIGS. 4*a*, 4*b* comprises an essentially rectangular frame 4 with two lateral portions 4*a*, 4*b* connected with each other by a frame body 4*c* (see FIG. 2*b*, 3*b*). The two lateral portions 4*a*, 4*b* have a first and a second cut-out 5, 6 arranged essentially perpendicular to each other, i.e. the first cut-out 5 is in the figure essentially horizontal and the second cut-out 6 is essentially vertical. The cut-outs 5, 6 are adapted to cooperate with the attachments pins 3*a*, 3*b* of the tool by means of a first attachment pin 3*b* is inserted in the first horizontal cut-out 5 and the second attachment pin 3*a* cooperates with and rests in the second vertical cut-out 6 (see also FIG. 1). The attachment to the arm of the earth moving machine or the tilt rotator can be made through two holes 7*a*, 7*b* arranged in the lateral portions 4*a*, 4*b*. Said locking segments 18*a*, 18*b* are arranged to be rotated in relation to the frame 4 in at least a first and a second direction between two different positions, whereby the locking segment 18*a*, 18*b* in at least one position delimits the first cut-out 5, in a direction non-parallel with the first cut-out.

In the rectangular frame 4 at least one actuator is arranged. In this embodiment the actuator 8 is a hydraulic cylinder, but it can also be an electrically operated engine, a compressed spring or another mechanical control arrangement. In one embodiment the actuator 8 is attached between on one side a locking arrangement 9 and on the other side a lock indication device 10 and the locking pistons 24*a* and 24*b* of the front pin locking arrangement 19 and is arranged to move the locking arrangement 9, the lock indication device 10 and the locking pistons 24*a*, 24*b* in relation to the frame 4. In another embodiment the actuator is arranged between on one side a locking arrangement 9 and on the other side a lock indication device 10 and the locking pistons 14*a*, 14*b* of the front pin locking arrangement 19 in that it is attached to the locking arrangement 9 and a locking plate 10*c* to which the lock indication device 10 is arranged to move the locking arrangement 9 and the lock indication device 10 and the locking pistons 24*a*, 24*b* in relation to the frame 4. In another embodiment the lock indication device 10 is removed. Since the actuator 8 is placed between the locking arrangement 9 respective the lock indication device 10 and the locking pistons 24*a*, 24*b*, the locking arrangement 9 respective the lock indication device 10 and the locking pistons 24*a*, 24*b* is essentially simultaneously moved in opposite direction R1, R1. In the embodiment according to FIG. 1-4 the locking arrangement 9 respective the lock indication device 10 and the locking pistons 24*a*, 24*b* are moved essentially parallel to the elongation direction of the first cut-out 5. In one embodiment the locking pistons are mechanically detached from the hydraulic cylinder, whereby the hydraulic cylinders only can actuate the movement of the locking pistons simultaneously in one direction. The direction of movement can in one embodiment be controlled by letting the locking plate 10*c* be led by a tension bolt 26 operating as a guide by letting the tension bolt 26 run through a lead-through in the locking plate 10*c*. A nut arranged on one end of the tension bolt prevents axial movement past an end position. Due to this arrangement the actuator 8 is suspended in its one end.

The actuator in the shape of a hydraulic cylinder 8 can be a cylinder comprising a piston 14 and a piston shaft 15, where the piston 14 delimit two fluid filled chambers in the cylinder. The adjustment between an open and a closed position is made by increasing or decreasing the pressure in the fluid filled chambers by means of a hydraulic valve 13. In one or both chambers, a compression spring 16 can be arranged. The spring 16 operates as a safety feature and acts on the piston 14 if something should break and the internal pressure in the chambers should disappear.

The locking arrangement 9 comprises as least one, in relation to the frame 4, moveable locking part 9*a*, 9*b*, with a first distal end 9*ay*, 9*by* and one second proximal end 9*ai*, 9*bi*. The distal end 9*ay*, 9*by* can be protruded out through an opening 11 in the frame 4 and lock one of the two locking pins 3*a*, 3*b* of the tool in the frame 4. Thus, the locking arrangement 9 can be said to have two positions; one first position (shown as an open position in FIGS. 3*a* and 3*b*) when the at least one locking part 9*a*, 9*b* is inserted in the frame 4 and a second position (shown as a locked position in FIGS. 4*a* and 4*b*) when the at least one locking part 9*a*, 9*b* protrudes from the frame 4 and delimits the second cutout 6 in a direction parallel to the first cutout 5. In such a way the second attachment pin 3*b* of the tool is safely locked in the quick coupler 1, i.e. the attachment pin 3*b* is prevented from being vertically pulled out from the second cutout 6. The at least one locking part 9*a*, 9*b* can also have a chamfer in its first distal end 9*ay*, 9*by* which is adapted after the shape of the one of the attachment pins 3*a*, 3*b* of the tool adapted to cooperate with the second cutout 6.

According to the embodiment shown in FIGS. 3 and 4, the locking arrangement 9 comprises two cylindrically shaped and elongated locking parts 9*a*, 9*b* which are connected with each other by a yoke 9*c*. The locking parts 9*a*, 9*b* are arranged to run through a respective opening 11 in the frame 4. Each opening 11 can be sealed by a sealing and/or a scraper (not shown) in order to seal off the space in the frame 4 where the actuator 8 is placed from dirt and moisture.

It is also conceivable that two or more actuators are used in another embodiment. These actuators can be separate or connected and act directly or indirectly on respective locking part 9*a*, 9*b*. The actuators can be controlled individually by separate or common hydraulic valves or by electrical or mechanical arrangements. It is also possible to mechanically connect the actuators by a locking plate 10*c*.

The lock indication device 10 comprises at least one elongated indication part 10*a*, 10*b* with a first distal end 10*ay*, 10*by* and a second proximal end 10*ai*, 10*bi*. The at least one indication part 10, 10*b* is arranged to run in an opening 12 in the frame 4 so that it in a first position is inserted in the frame 4 and in second position protrudes from the frame 4 and becomes visible from outside the frame 4. In order to make it even easier for the observer, which can be the driver or other person, to see the indication part, the distal end 10*ay*, 10*by* of the at least one indication part 10*a*, 10*b* can have a color different from the color of the frame 4. If a fluorescent color is used the indication part is also visible during darker conditions.

In the embodiment according to FIGS. 3 and 4 the indication parts are two cylinders 10*a*, 10*b* connected with a connection part or locking plate 10*c*. The cylinders 10*a*, 10*b* are arranged to run parallel in two openings 12 in the frame 4. If two cylinders 10*a*, 10*b* are used to indicate if the lock is locked or open a better/more secure display is achieved, especially when the observer is standing in a direction across from the side or directly under the tool and quick coupler.

The two openings 12 in the frame 4 can comprise a seal and/or a scraper (not shown) in order to further seal off the space inside the frame 4. Of course it is also possible to enclose the entire space inside the frame 4, for example by attaching a lid (not disclosed) to the frame base 4*c*. If the actuator 8 is placed in a sealed space, the life of the actuator is increased.

As is clear from FIG. 3 and FIG. 4 the front pin locking arrangement 19 comprises the locking pistons 24*a*, 24*b*, the locking segments 18*a*, 18*b*, with their respective spring (not shown) and the middle axle 17. The locking pistons comprise two essentially cylindrical parts which in one embodiment are connected to each other by the locking plate 10*c*. However, in a preferred embodiment the locking pistons are mechanically disconnected from both the locking plate 10*c* and the hydraulic cylinder 8, whereby the hydraulic cylinder through the locking plate 10*c* indirectly act on the locking pistons 24*a*, 24*b* and are thereby adapted to actuate movement of the locking pistons 24*a*, 24*b* in only one direction. The locking pistons are arranged to run through the respective hole 25*a*, 25*b* in the frame 4. Each hole 25*a*, 25*b* can be sealed by a seal and/or by a scraper (not shown) so that the interior of the frame 4 where the actuator is placed is sealed from dirt and moisture. The holes 25*a*, 25*b* are arranged at a position in the frame corresponding to the position of each locking segment 18*a*, 18*b*, so that the locking pistons 24*a*, 24*b* can be brought into contact with each locking segment 18*a*, 18*b* and a partial area of the locking plate 10*c*. The position of the holes 25*a*, 25*b* are preferably a bit vertically dislocated either upwards or downwards in relation to the center of rotation of the locking segments 18*a*, 18*b*. Due to their placement between the locking plate and the locking segments 18*a* and 18*b*, the movements of the locking pistons pass an axial end position and out from the holes 25*a*, 25*b* are prevented. An advantage with letting the locking pistons 24*a*, 24*b* be mechanically disconnected from the locking plate 10*c* and the hydraulic cylinder 8 is that you can prevent entering of dirt and moisture through the holes 25*a* and 25*b*, due to the fact that the locking pistons 24*a*, 24*b* is not forced to move a long distance into the holes 25*a*, 25*b* by movement of the locking plate 10*c* and the cylinder 8.

The locking pistons 24*a*, 24*b* are arranged to move essentially between an outer and an inner position. In the outer position at least one point or surface section of the outer ends 24*ay*, 24*by* of the locking pistons are located at a shorter first distance from the center of rotation 18*ac*, 18*bc* of the locking segments compared to an inner more inserted position in the frame 4 when this distance is larger compared to a second distance. When the locking arrangement is in an open position according to FIG. 3*a*-3*b*, a third distance can exist between the locking pistons 24*a*, 25*b* and the locking plate 19*c*, whereby the locking segments can rotate in both directions, i.e. in a second direction clockwise in the figure and a first direction anti-clockwise in the figure. The outer circumference of the locking segments are thus rotating freely because their maximum radius from the centre of rotation to the cam surface portion, which will bear against the outer ends 24*ay*, 24*by* of the locking pistons during rotation is smaller than the sum of a possible third distance between the locking plate 10*c* and the inner ends 24*ai*, 24*bi* of the locking pistons and the distance from the centre of rotation 18*ac*, 18*bc* of the locking segments 18*a*, 18*b* to the outer ends 24*ay*, 24*by* of the locking pistons, i.e. either the first or the second distance depending on the position of the locking device. In one embodiment where the locking plate 10*c* is connected to the locking pistons 24*a*, 24*b* and adapted to move simultaneously with these in both directions, the third distance will always be null. The third distance is also equal to null when the locking arrangement 9 is in a locked position.

During a rotation in the second direction the cam surfaces of the locking segments 18*a*, 18*b*, which have a relatively close distance to the centre of rotation 18*ac*, 18*bc* along the ends of the locking pistons 24*a*, 24*b*, will glide along the outer ends 24*ay*, 24*by* of the locking pistons whereby the locking pistons are not moved towards the locking plate 10*c*. During a rotation in a first direction of the locking segments 18*a*, 18*b* a part of the cam surface on a relatively greater distance front the center of rotation 18*ac*, 18*bc* will be pressed towards the outer ends 24*ay*, 24*by* of the locking pistons so that they are transferred towards the locking plate 10*c* and an inner position until the locking segments are allowed to rotate free from the outer ends 24*ay*, 24*by* of the locking pistons. The maximum radius from the centre of rotation to the cam surface which will bear against the outer ends 24*ay*, 24*by* of the locking pistons during rotation is smaller than the sum of the third distance between the locking platen 10*c* and the inner ends 24*ai*, 24*bi* of the locking pistons and the distance from the centre of rotation 18*ac*, 18*bc* of the locking segments 18*a*, 18*b* to the outer ends 24*ay*, 24*by* of the locking pistons, i.e. the first or second distance depending on the position of the locking arrangement 9.

Figure 4A:
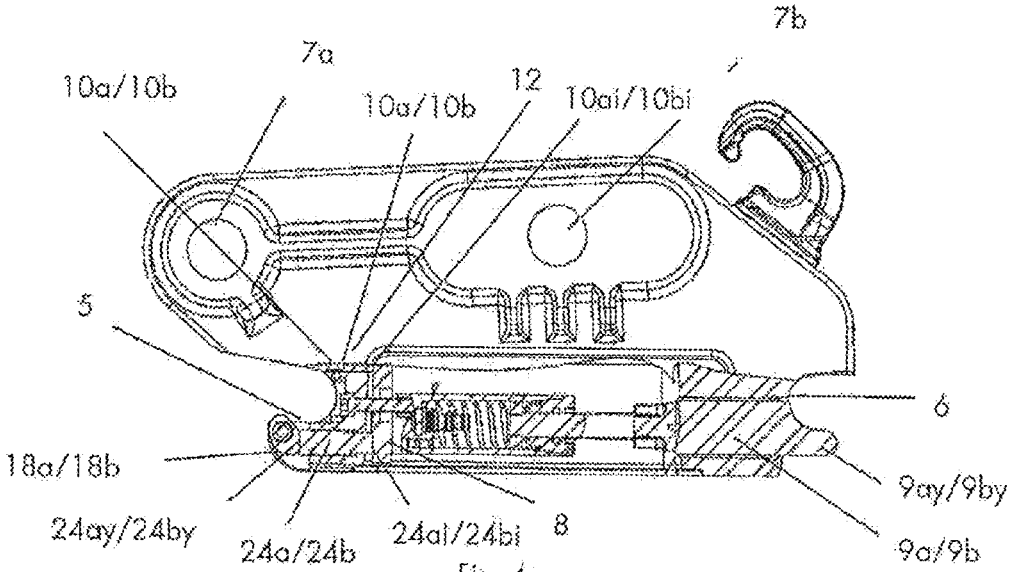
FIG. 4*a* shows a side view of a quick coupler in a locked position.
Figure 4B:
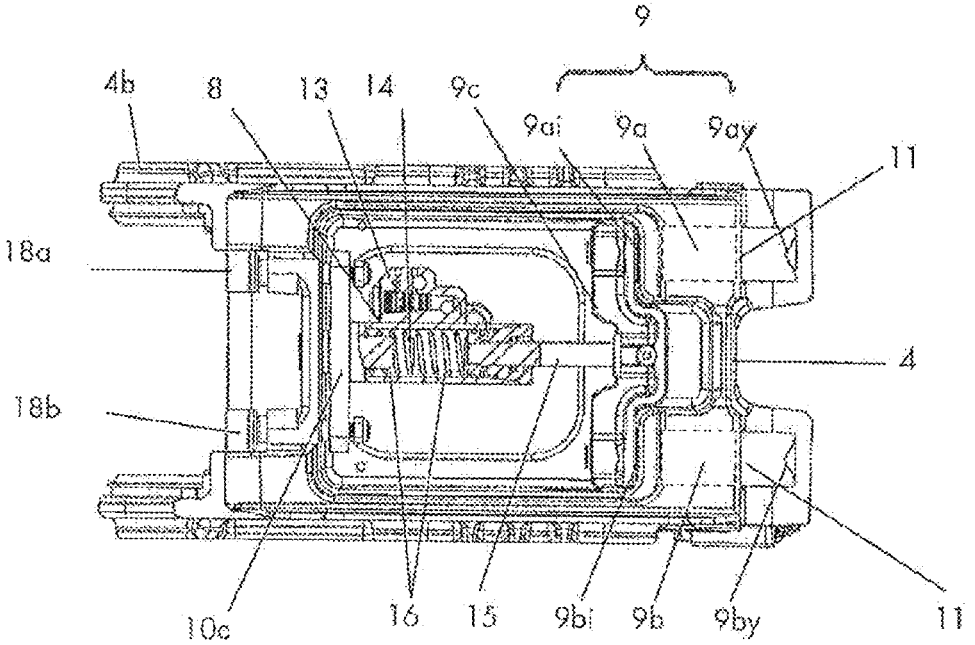
FIG. 4*b* shows a plan view of a quick coupler in a locked position.

When the locking arrangement 9 is in a locked position according to FIG. 4*a*-4*b* the locking pistons bear on one sides against the respective locking segment 18*a*, 18*b* and on the other sides against a partial surface of the locking plate 10*c*, whereby the locking segments due to their cam surface design can be brought into rotation in the second direction, but not in the first direction. In the other direction the cam surface of the locking segments 18*a*, 18*b* which have a relatively near distance to the centre of rotation 18*ac*, 18*bc*, slide along the ends of the locking pistons 24*a*, 24*b*, i.e. just as previously when the locking arrangement is in an open position. In the first direction a cam surface on a relatively greater distance from the centre of rotation 18*ac*, 18*bc* prevents rotation because it bear against the ends of the locking pistons 24*a*, 24*b*, whose movement in their turn are prevented by their contact against the locking plate 10*c* with their other ends 24*ai*, 24*bi*. The maximum radius from the centre of rotation 18*ac*, 18*bc* to the cam surface which will bear against the outer ends 24*ay*, 24*by* of the locking pistons during rotation is larger than the sum of the third distance between the locking plate 10*c* and the inner ends 24*ai*, 24*bi* of the locking pistons and the distance from the centre of rotation 18*ac*, 18*bc* of the locking segments 18*a*, 18*b* to the outer ends 24*ay*, 24*by* of the locking pistons corresponding to the first or the second distance depending on the position of the locking device 9.

FIG. 5*a*-5*d* discloses components of the front pin locking arrangement and their possible locations in more detail. The front pin locking arrangement 19 comprises two locking pistons 24*a* and 24*b* moveably arranged in the holes 12 to move in an essentially horizontal direction, i.e. in parallel to the first horizontal cut-out 5 and the indication devices 10*a* and 10*b* between the outer and the inner position.

Figure 5A:
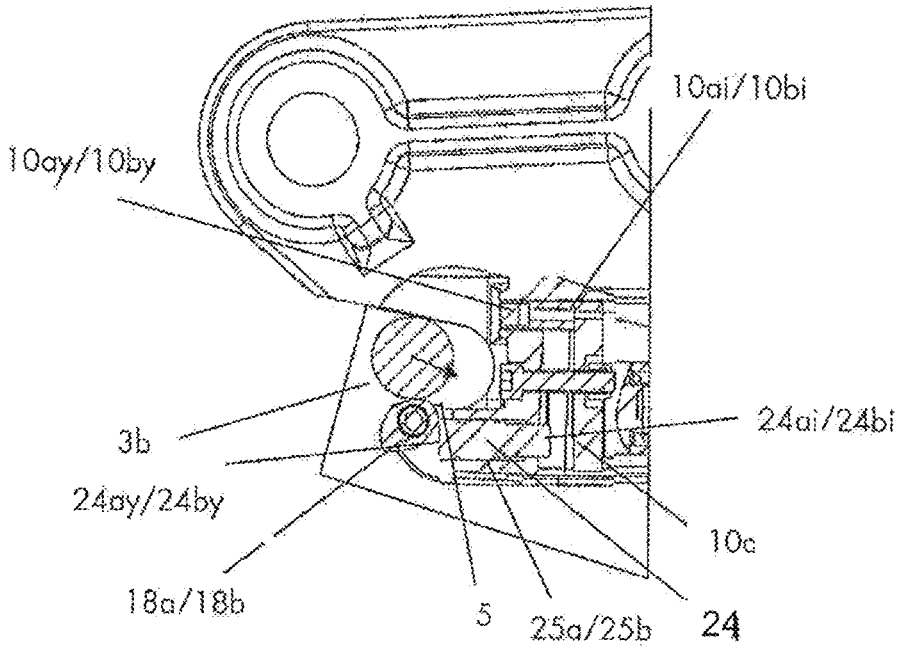
FIG. 5*a* shows a front pin locking arrangement according to FIG. 4*a* and FIG. 4*b* in a locked position during insertion of a front pin.

FIG. 5*a* disclose the front pin locking arrangement 19 during insertion of a first attachment pin 3*b*, such as a front pin, when the locking arrangement 9 is in an open position and the locking pistons 24*a*, 24*b* are in an outer position. The first attachment pin 3*b* slides over the cam surfaces of the locking segments 18*a*, 18*b* and cause them to rotate in a second direction (clockwise in the figure) where after the first attachment pin 3*b* is inserted and rests in the first horizontal cut-out 5. After the attachment pin 3*b* have slide pass the locking segments 18*a*, 18*b*, the springs of the locking segments 18*a*, 18*b* will force the locking segments 18*a*, 18*b* to rotate in a first locking direction (counter clockwise in the figure) and enclose the attachment pin in the first horizontal cut-out. In the figure it is also disclosed how the at least one indication part 10*a*, 10*b* is arranged in an inserted position in the frame 4, whereby it is not visible from the outside of the frame 4.

Figure 5B:
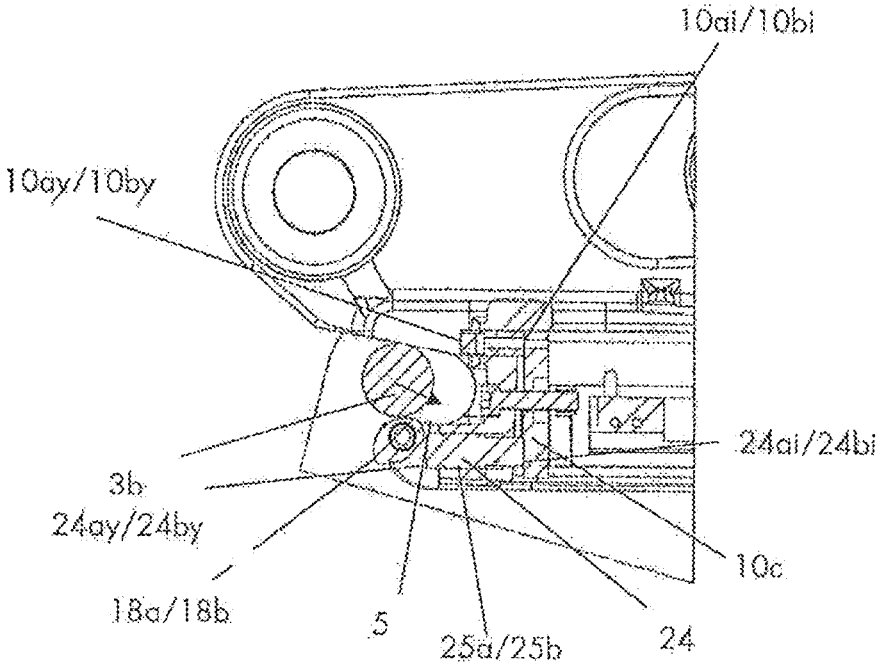
FIG. 5*b* shows a front pin locking arrangement according to FIG. 3*a* and FIG. 3*b* in an unlocked position during insertion of a front pin.

FIG. 5*b* shows the front pin locking arrangement 19 during insertion of a first attachment pin 3*b*, such as a front pin, in the first horizontal cut out 5 when the locking arrangement 9 is in a closed position. The first attachment pin 3*b* slides over the cam surfaces of the locking segments 18*a*, 18*b* and cause them to rotate in a second opening direction (clockwise in the figure) where after the first attachment pin 3*b* is inserted and rests in the first horizontal cut-out 5. After the attachment pin 3*b* have slide pass the locking segments 18*a*, 18*b*, the springs of the locking segments 18*a*, 18*b* will force the locking segments 18*a*, 18*b* to rotate in a first locking direction (counter clockwise in the figure) and enclose the attachment pin in the first horizontal cut-out. In the figure it is also disclosed how the at least one indication part 10*a*, 10*b* is arranged in a protruding position in the frame 4, whereby it is visible from the outside of the frame 4.

Figure 5C:
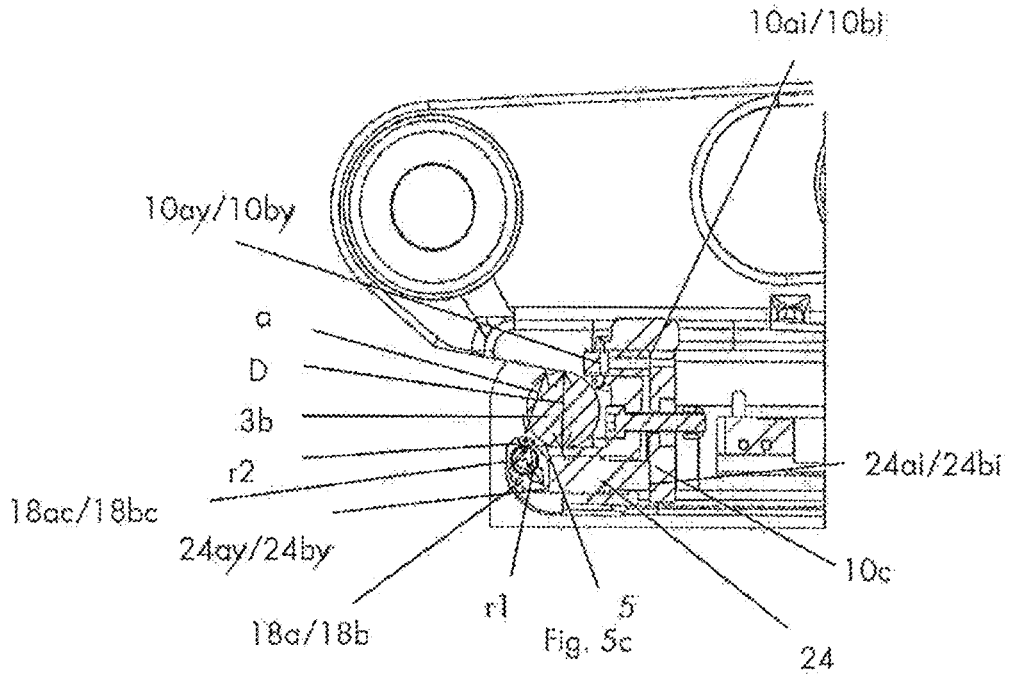
FIG. 5*c* shows a front pin locking arrangement where the front pin is clamped, and FIG. 5*d* a front pin locking arrangement according to FIG. 3*a* and FIG. 3*b* in an unlocked position during exit of a front pin.

FIG. 5*c* is the position after both FIG. 5*a* and FIG. 5*b* after the locking arrangement have been brought to a locked position, if it is not, as in FIG. 5*b*, already is in the locked position. Because the locking pistons 24*a*, 24*b* bear against the respective locking segment 18*a*, 18*b* at one of their ends, and against the locking plate 10*c* in their other ends, the locking segments can no longer rotate in the first direction and thereby the attachment pin 3*b* is locked in its position in the first horizontal cut-out 5. An operator about to attach a tool to an excavator thereafter angle the tool coupler in such an angle that the attachment pin 3*b* rests in its position in the horizontal cut-out 5 without sliding out when the locking arrangement is brought in an open position, at the same time as the tool coupler is even more angled so that the vertical cut-out 6 is brought towards the second attachment pin 3*a*. When the attachment pin is brought into contact with the vertical cut-out 6, the locking arrangement is put into a locked position whereby the at least one locking part 9*a*, 9*b* protrudes from the frame 4 and delimits the second cut-out 6 in a direction parallel with the first cut-out 5. In this way the second attachment pin 3*a* of the tool is securely locked in the quick coupler 1, i.e. the attachment pin 3*a* is prevented from being vertically pulled out of the second cut-out 6, at the same time as the front attachment pin is locked in the horizontal cut-out. The tool is now locked to the quick coupler.

In FIG. 5*c* it is also shown how the at least one indication part 10*a*, 10*b* is in a protruded position out of the frame 4, whereby it is visible from the outside of the frame 4. In the same FIG. 5*c* the cam surface of the locking segment is shown, by which the radius from the centre of rotation 18*ac*, 18*bc* varies along the circumference of the locking segment, whereby the locking segment has a cam surface sector, which theoretically can be an infinitesimal small point along the circumference of the locking segment, at a corresponding first radius r1 and a second radius r2, whereby the first radius r1 is larger than the second radius r2. What so far has been described as a relatively larger distance between the cam surface to the centre of rotation thus corresponds to the radius r1 and a relatively shorter distance to the centre of rotation correspond to r2. In the figure it is shown that the attachment pin 3*b* has a diameter D. In order to firmly hold the attachment pin in place when it rests in the horizontal cut-out 5, r2 can preferably be defined as being of such a length that its corresponding cam surface section is at a smaller distance a to the opposite wall of the opening when the at least one locking arrangement 9 is in a locked position and the first attachment pin 3*b* has been inserted to rest in the horizontal cut-out 5 and the locking segments are in a position where they delimit the first cut-out, so that a is smaller than D. The radius r1 can in the same position be defined as in the same position have a corresponding cam surface section which in this position bear against a part of the outer end 24*ay*, 24*by* of the locking piston. The contact can be touching as disclosed in FIG. 5*c*, where the cam surface section corresponding to r1 bear against the lower part of the outer end of the locking piston, but in this example it is obvious that several r1 can fulfill the demand of being longer than the first distance by the design of the essentially plane vertical cam surface section which bear against the majority of the outer end 24*ay*, 24*by* of the locking piston.

Figure 5D:
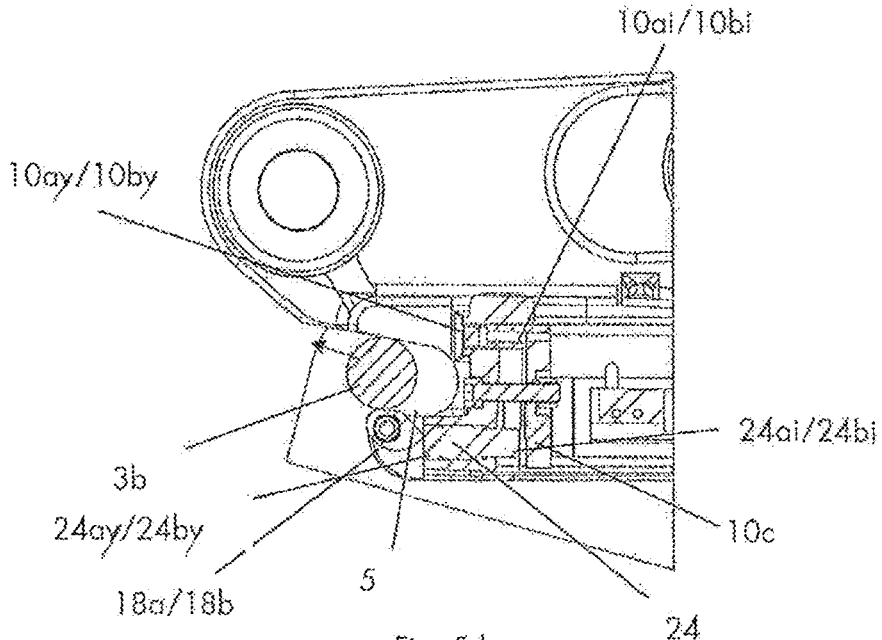

FIG. 5*d* disclose the front pin locking arrangement 19 during insertion of a first attachment pin 3*b*, such as a front pin, in the first horizontal cut-out 5, when the locking arrangement is in an open position. Since a distance have been formed between the locking plate 10*c* and the inner ends 24*ai*, 24*bi* of the locking pistons and since the locking pistons 24*a*, 24*b* can be moved to a larger distance from the locking segments 18*a*, 18*b* and their centre of rotation, the locking segments 18*a*, 18*b* can be brought to rotate by letting their essentially plane surfaces press the locking pistons 24*a*, 24*b* in the direction towards the locking plate 10*c* and thereby they are free from the ends of the locking pistons 24*a*, 24*b*. Hereby the attachment pin 3*b* can be taken out from a position in the horizontal cut-out 5, to a position outside this and thus outside the attachment device. In the figure it is also shown how the at least one indication part 10*a*, 10*b* is in an inserted position in the frame 4, whereby it is not visible outside the frame 4. An operator which desires to switch tools or setting a tool free from its excavator, will put the locking arrangement in an open position, whereby the attachment pin 3*a*, can be set free from the tool coupler and its position in the vertical cut-out, by inserting the at least one locking part 9*a*, 9*b* in the frame 4. During a maintained open position of the locking device the attachment pin 3*b* can be brought out of its position in the horizontal cut-out 5 according o the description above.

The invention claimed is:

1. A quick coupler for attaching a tool, comprising an attachment bracket with two parallel attachment pins, to an earth moving vehicle, wherein the quick coupler comprises a frame with a first cut-out and a second cut-out arranged substantially perpendicular to each other, where each respective cut-out is adapted to cooperate with a respective attachment pin of the tool, at least one locking arrangement, moveable in relation to the frame and adapted to delimit the second cut-out in a direction parallel to the first cut out, whereby one of the attachment pins of the tool is locked up in the cutout, one single actuator arranged in the frame adapted to move the at least one locking arrangement between a first open position, corresponding to a retracted position of the actuator, and a second locked position, corresponding to an extended position of the actuator, at least one locking piston arranged to be moved between an inner position and an outer position, and at least one locking segment arranged to be rotated in relation to the frame in a first direction and a second direction between different positions, whereby the locking segment in at least one position delimits the first cut-out, characterized in that the one single actuator is arranged between the at least one locking arrangement and the at least one locking piston and is arranged to move both the at least one locking arrangement and the at least one locking piston in relation to the frame, that the at least one locking segment is arranged in relation to the at least one locking piston so that the at least one locking segment is prevented from rotating in the first direction, to prevent removal of the respective attachment pin from the first cut-out, when the locking arrangement is in the second locked position and is allowed to rotate in the first direction, to allow removal of the respective attachment pin from the first cut-out, when the at least one locking arrangement is in the first open position, that the at least one locking segment is arranged in relation to the locking piston so that the at least one locking segment is allowed to rotate in the second direction, to allow insertion of the respective attachment pin into the first cut-out, when the at least one locking arrangement is in either the locked position or the open position, where the at least one locking segment is arranged to rotate in relation to the at least one locking piston, wherein the at least one locking piston has an outer end and an inner end whereby the at least one locking segment is arranged in relation to the at least one locking piston so that at least some point on the outer end of the at least one locking piston is located at a first distance from the centre of rotation of the at least one locking segment at the outer position of the at least one locking piston, when the at least one locking arrangement is in the locked position, and where at least some point on the outer end of the at least one locking piston is located at a second distance from the centre of rotation of the at least one locking segment at the inner position of the at least one locking piston, when the at least one locking arrangement is in the open position, where the first distance is less than the second distance, where the at least one locking segment has a cam surface, by which the radius from the centre of rotation to the cam surface varies along the circumference of the locking segment, whereby the at least one locking segment has a cam surface section at a corresponding first radius and a second radius, whereby the first radius is larger than the second radius, wherein the first radius of the at least one locking segment is larger than the first distance at the outer position of the at least one locking piston, when the locking arrangement is in the locked position, and smaller than the second distance at the inner position of the at least one locking piston, when the at least one locking arrangement is in the open position, and wherein the second radius is smaller than the first distance at the outer position of the at least one locking piston, when the at least one locking arrangement is in the locked position and smaller than the second distance at the inner position of the at least one locking piston, when the at least one locking arrangement is in the open position.

2. A quick coupler according to claim 1, characterized in that a locking plate is attached to the one single actuator, whereby the inner end of the at least one locking piston is mechanically disconnected from the locking plate, whereby the inner end of the at least one locking piston is at a third distance from the locking plate, whereby the third distance is null when the at least one locking arrangement is in the locked position.

3. A quick coupler according to claim 2, characterized in that the first radius of the at least one locking segment is larger than the sum of the first distance and the third distance when the at least one locking arrangement is in the locked position and smaller than the sum of the second and the third distance when the at least one locking arrangement is in the open position and where the second radius is smaller than the sum of the first and the third distance when the at least one locking arrangement is in the locked position and smaller than the sum of the second and the third distance when the at least one locking arrangement is in the open position.

4. A quick coupler according to claim 2, characterized in that the quick coupler further comprises a lock indication device which visually indicates if the locking arrangement is in the open position or the locked position, in which the one single actuator is arranged between the at least one locking arrangement and the at least one lock indication device wherein the single actuator is arranged to move both the at least one locking arrangement and the lock indication device in relation to the frame so that the lock indication device visually indicates when the at least one locking arrangement is in the baked position, whereby the lock indication device and the at least one locking piston are arranged in the locking plate on the same side of the one single actuator.

5. A quick coupler according to claim 1, characterized in that the quick coupler is adapted to cooperate with a first attachment pin of the tool with a first diameter, wherein the quick coupler is adapted to receive the first attachment pin through an opening to rest in the first cut-out, whereby the cam surface section at the second radius is located on a shortest distance to an opposite wall of the opening when the at least one locking arrangement is located in the locked position and the first attachment pin is inserted to rest in the first cut-out and the at least one locking segment is limiting the first cut-out, whereby the cam surface section at the first radius at this position touches a part of the outer ends of the at least one locking piston, whereby the first radius is of such a length that the first diameter is larger than the shortest distance to the opposite wall of the opening when the at least one locking arrangement is located in the locked position and the first attachment pin is inserted to rest in the cut-out and the at least one locking segment delimits the first cut-out.

6. A quick coupler according to claim 1, characterized in that the at least one locking piston is adapted to be moved essentially linearly by the one single actuator in at least one direction essentially parallel to the extension direction of the first cut-out.

7. A quick coupler according to claim 6, characterized in that the at least one locking arrangement and the at least one locking piston are arranged to be moved essentially simultaneously in opposite directions.

* * * * *